US006773066B2

(12) United States Patent
Caldwell

(10) Patent No.: US 6,773,066 B2
(45) Date of Patent: Aug. 10, 2004

(54) CONTROL FOR A SEAT, AND A SEAT INCORPORATING IT

(76) Inventor: John W. Caldwell, 1829 Warwick Rd., San Marino, CA (US) 91108

( * ) Notice: Subject to any disclaimer, the term of this patent is extended or adjusted under 35 U.S.C. 154(b) by 0 days.

(21) Appl. No.: 10/245,847

(22) Filed: Sep. 17, 2002

(65) Prior Publication Data

US 2004/0051359 A1 Mar. 18, 2004

(51) Int. Cl.[7] ..... A47C 1/024; A47C 1/02

(52) U.S. Cl. ..... 297/302.1; 297/302.3; 297/303.1; 297/325

(58) Field of Search ..... 297/302.1, 302.3, 297/303.1, 325, 326; 248/146, 655

(56) References Cited

U.S. PATENT DOCUMENTS

| | | | | | |
|---|---|---|---|---|---|
| 1,722,543 | A | * | 7/1929 | Selje | 297/302.6 |
| 3,025,058 | A | | 3/1962 | Brumfield | |
| 4,796,950 | A | * | 1/1989 | Mrotz et al. | 297/303.3 |
| 4,889,384 | A | * | 12/1989 | Sulzer | 297/303.4 |
| 4,911,501 | A | * | 3/1990 | Decker et al. | 297/300.8 |
| 5,288,138 | A | * | 2/1994 | Stulik et al. | 297/302.1 |
| 5,417,474 | A | * | 5/1995 | Golynsky | 297/302.1 |
| 5,664,835 | A | * | 9/1997 | Desanta | 297/302.1 |
| 5,967,609 | A | | 10/1999 | Potter | |
| 6,595,584 | B1 | * | 7/2003 | Caldwell | 297/258.1 |
| 2002/0005658 | A1 | * | 1/2002 | Piretti | 297/302.3 |

FOREIGN PATENT DOCUMENTS

| | | | | |
|---|---|---|---|---|
| DE | 3800751 A1 | * | 8/1988 | A47C/1/032 |
| EP | 130229 A1 | * | 1/1985 | A47C/3/12 |

* cited by examiner

*Primary Examiner*—Peter M. Cuomo
*Assistant Examiner*—Sarah C. Burnham
(74) *Attorney, Agent, or Firm*—Donald D. Mon

(57) ABSTRACT

A control for a seat, and a seat in combination with the control and a base, said control comprising an upper and a lower arm pivotally joined, with a flexure extending as a cantilever between them, such that a contactor contacts the flexure, and both permits and limits the tilting movement of the seat.

6 Claims, 5 Drawing Sheets

CONTROL FOR A SEAT, AND A SEAT INCORPORATING IT

FIELD OF THE INVENTION

A control that mounts a seat support to a base for rocking motion, and a seat which incorporates it.

BACKGROUND OF THE INVENTION

Persons seated in public seating are frequently impatient and distracted. The realities of the situation are often such that a wait may seem longer and be less pleasant than it really is, or should be. It is an objective of a sympathetic supplier of public seating to make the situation as comfortable, and as pleasant as possible. However, as will be seen, there are limitations as to how far these efforts can go.

Especially in medical and surgical offices, the accommodation of waiting patients and their companions is a significant problem, requiring tolerance and empathy for the discomfort and attitude of ailing and impatient persons who are often impaired or otherwise suffering from worry and concern for themselves and for others dear to them, and who are impatient with delays. Beyond this compassionate concern is the sensible objective of providing them with safe and accessible seating structures which will support them without adding to their miseries, and from which they can rise without unnecessary additional discomfort.

As to their comfort, when they are seated, it is usually best for their feet to rest directly on the floor without constricting circulation of the blood to the legs. For patients with many of the most frequent ailments, it is also useful to provide seat motion that can be restful or distracting. A rocking motion is an example. However for other types of ailments, such as some heart problems, such motion should be avoided because of the possibility of a fright reaction when the person sits down on a chair which yields and rocks. A control according to this invention can prevent or allow the rocking motion.

Sanitation in all public seating, medical and otherwise, is a serious concern. Ease of cleaning, such as by steam cleaning and wash-down with astringent solutions are objectives which often cannot be met without severely damaging the seat, for example its upholstery. It is an object of this invention to provide a control which can be sanitized without disassembly or damage.

Unyielding structures, and structures that rock but are not self-limiting, and which require steadiness of the occupant are not only uncomfortable, but often are risky and alarming to a patient in a doctor's waiting room who needs sensible restraint. For example, some coronary patients require firm stability, and some patients with balance disorders are distressed by a movable support.

It is an object of this invention to provide a seat control that provides sensibly deflectable support which can, if desired, be adapted for limited rocking motion with minimal changes in the alignment of the user's seat, legs and back.

In addition, the rocking elements can preferably either be locked out or eliminated entirely for use in situations where the user would possibly be alarmed by movement of the structure. Heart disease patients constitute an example of such people.

BRIEF DESCRIPTION OF THE INVENTION

A control according to this invention is used to mount a support to a base. The control preferably provides for a knee action tilt movement that enables the support to engage in a rocking motion. Optionally, this movement may be disabled (or not provided at all) so that the support could be locked to the base in a selected alignment.

One useful base has two laterally spaced apart struts, with two legs each that contact the floor, with an intersection forwardly of the midpoint between their points of contact with the ground.

The support is intended comfortably to receive the seated person. It includes a bottom and a back. While both the bottom and the back may be made of rigid material, this invention enables the use of flexible material for both which is able to afford at least some conformation with the user.

The support is mounted to the base by the control which is supported by the base beneath the support. The control preferably is mounted between bridging cross arms extending between two sides of the support. The support is thereby mounted to and above the base with the capacity either to rock relative to the base, or to be locked or otherwise held in one position above the base. A second set of bridging cross arms extends between the struts.

In one useful application of this control, the forward edge of the bottom is curled downwardly, with a radius which will allow an average person to sit on the bottom with his or her feet flat on the floor, comfortably and without restrictive compressive pressure on the bottom of the legs under the knee. Especially when the control permits rocking movement, the user can leave the seat while his or her feet are flat on the ground, and will not tend to tumble or slip when the support tilts forwardly. This enables a safe and comfortable exit from the seat.

The control includes a reference pivot rigidly fixed relative to the base. Its axis of rotation is located near the center of the radius of the lip of the bottom of the support, and by this arrangement is under the knee. This control enables such an arrangement.

The support's center of gravity is behind the reference pivot, so that with or without the capacity to rock, the user's center of gravity will be behind the pivot point. When rocking motion is to be enabled, the control comprises a control arm fixed to the support and rotatably mounted to the base, a stiff flexure comprising a cantilever arm rigidly mounted to the base, and a contactor rigidly mounted to the support and in contact with the cantilever arm. The unloaded contact of the contactor and the cantilever arm biases the support toward its upright position.

According to still another preferred but optional feature of this invention, all of the parts of the control are constructed of materials that will not be damaged by water, steam, or by conventional sanitizing solutions.

The above and other features of this invention will be fully understood from the following detailed description and the accompanying drawings, in which:

DETAILED DESCRIPTION OF THE INVENTION

The specific seat construction described herein is given as an example of the use of the control and to illustrate its advantages. The control is useful with many other seat and support shapes and configurations.

A seat 10 according to this invention is intended to rest firmly on a floor 11, or if desired to be tilted and moved around the floor on rollers. It is intended to be lightweight, but strong enough to support even a very heavy person, still without appearing to be, and certainly not being, a heavy article of furniture. Its intended function is not only to be comfortable and affordable, but also to be attractive, without the appearance of an "institutional" piece of furniture. Accordingly it is principally made of castings, extrusions which can be slim and unobtrusive, and of fabric which is suitably flexible and thin. This combination enables the chair or furniture group to be cleaned without damage.

Figure 3:
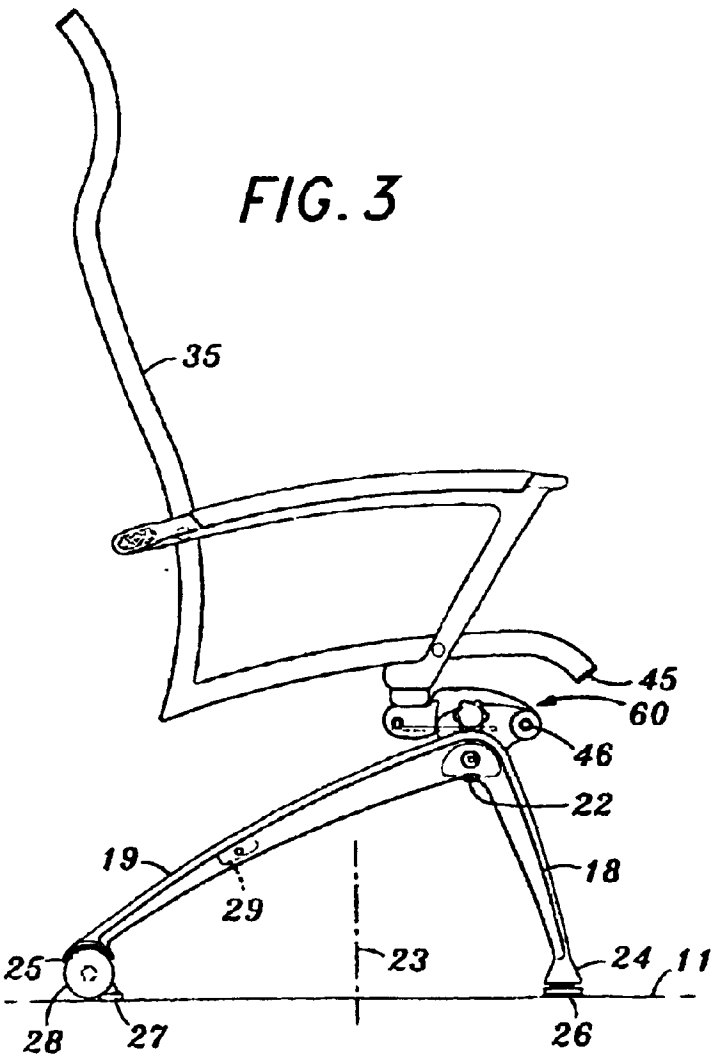
FIG. 3 is a right hand side view of the chair of FIG. 1.

A base 15 comprises a pair of struts 16, 17. Strut 16 has two legs 18, 19. Strut 17 has two legs 20, 21. They are mirror images of one another, so only strut 16 will be described in detail. Its rear leg 19 and forward leg 18 meet at a junction 22 that is forward of the mid-point 23 (see FIG. 3) between the lower ends 24, 25 of the legs. Accordingly, the rear leg 19 makes a smaller angle with the floor than forward leg 18.

A pad 26 is attached to the bottom end of the forward leg. Preferably it is screw-mounted to the leg so it can be raised or lowered to compensate for irregularities in the floor.

The bottom end of rear leg 19 has a pad 27 mounted where it will contact the floor when the base is fully in contact with the floor. Rollers 28 are rotatably mounted to the rear legs, but are spaced from the pad so that when the pad contacts the floor, the rollers do not. When the seat is to be moved, the base is tilted around the bottom of the rear legs. This moves the rollers into contact with the floor, and moves the pads out of contact with the floor. The seat can then readily be wheeled to a new location.

A rearward first cross beam 29 rigidly interconnects the rear legs of the two struts. A forward second cross beam 30 rigidly interconnects the struts near the junctions of the legs. Cross beam 29 resists spreading of the rear legs. Cross beam 30 is more substantial for reasons which will become apparent. It must resist stronger bending and torsional forces than the cross beam 29.

The seat further includes a support 35, that receives and supports the person. It includes a bottom 36 and a back 37. Rails 38, 39 are provided at opposite sides of the back. Rails 40, 41 are provided at opposite sides of the bottom. The respective rails are strong and provide support for webs 42, 43 which the user rests on. The webs are strongly held to the rails by means of no importance to this invention.

The bottom has a gradually convex upward contour extending from its rear end to a forward lip 45. This lip is arcuate, with an approximate center of curvature 46, whose location will further be discussed below.

Figure 4:
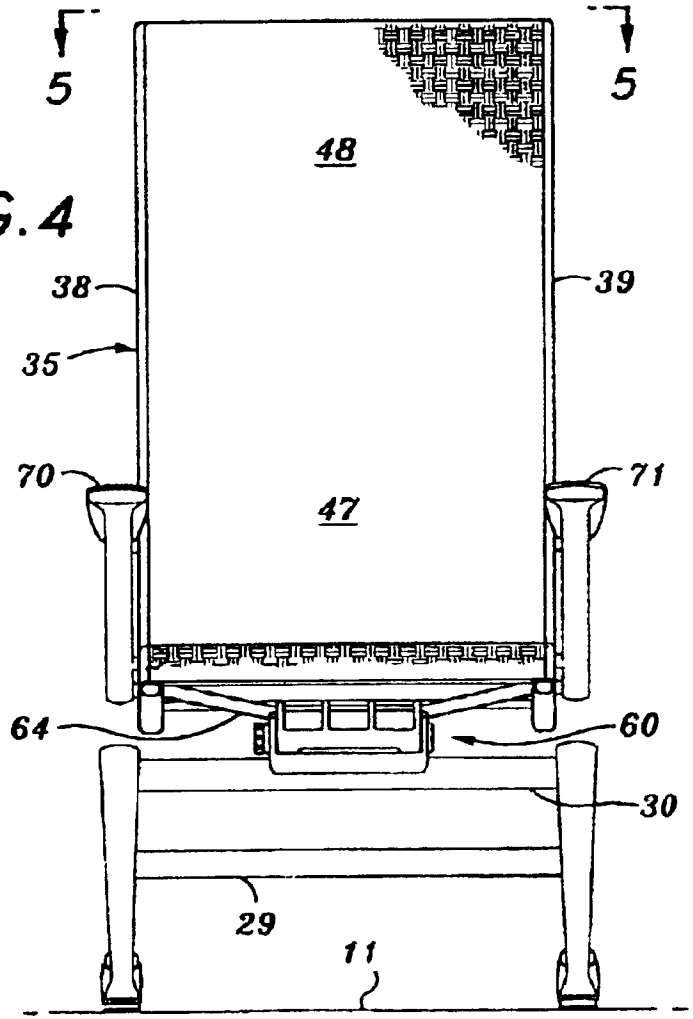
FIG. 4 is a front elevation of the chair of FIG. 1.

While the contour of the back is arbitrary, a convex lumbar portion 47 is preferably provided for comfort, and on taller seats, also a convex head rest 48 (FIG. 4). This type of back is most useful for a "patient" chair, in which an indisposed person must rest for a considerable time. A fabric web will provide a comfortable fit. Instead of a fabric web, inflexible pieces such as slats may be used, or more rigid, perhaps molded plastic shapes can be used when long-term comfort and attractiveness are of less importance.

Figure 5:
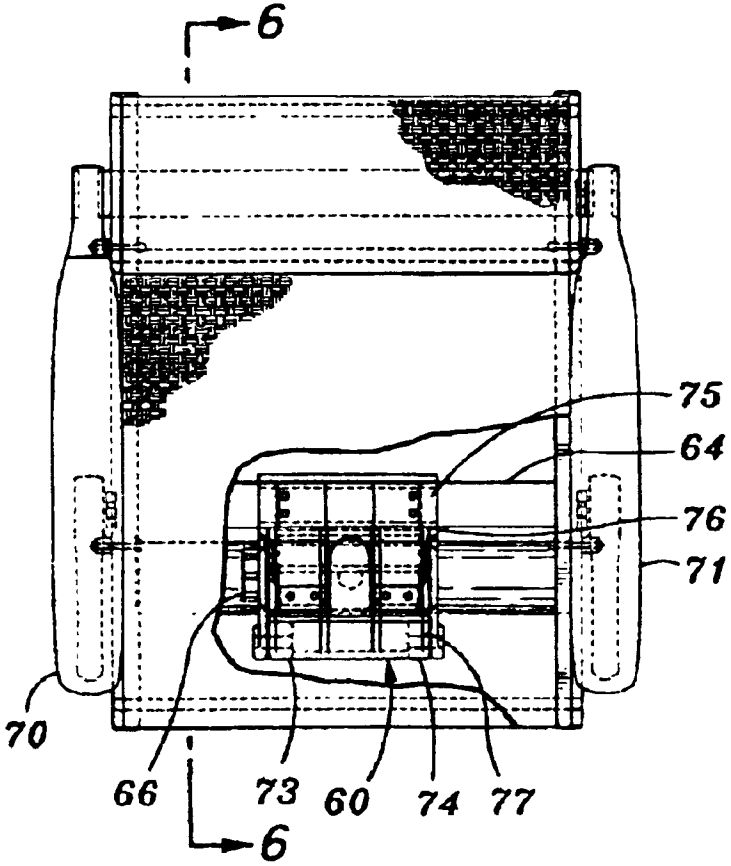
FIG. 5 is a top view of the chair of FIG. 1, partly in cutaway cross-section.
Figure 8:
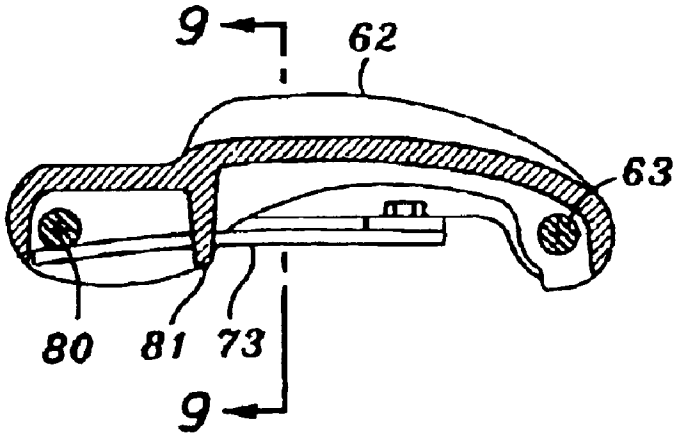
FIG. 8 is a central cross-section of the top part of the control.
Figure 9:
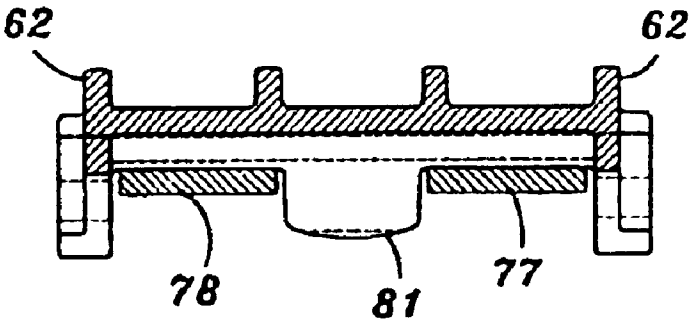
FIG. 9 is a cross-section taken at line 9—9 in FIG. 8.
Figure 7:
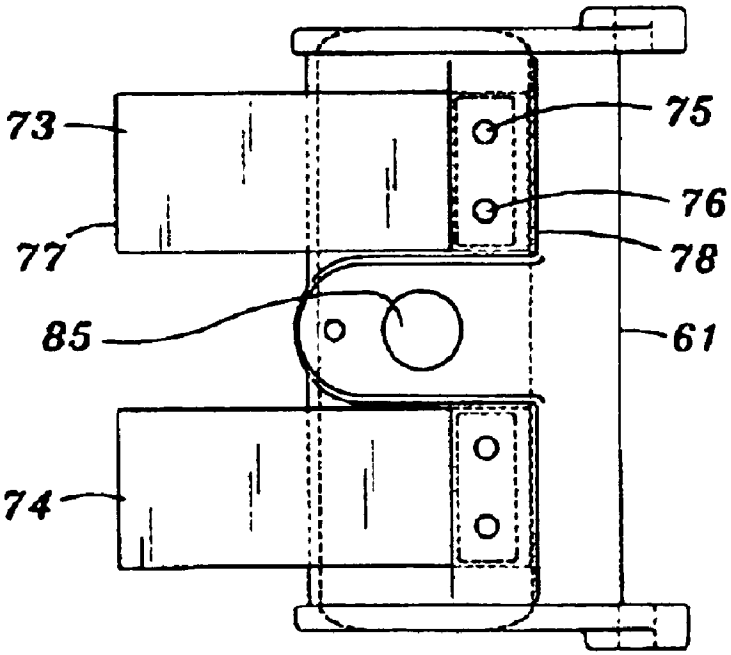
FIG. 7 is a top view of the bottom part of the control.

A control 60 (FIGS. 5 and 6) interconnects the base and the support. Its purpose is to mount the support for a knee action tilt (convexly upward) rocking motion. Its lower arm 61 (or "jaw") is bolted to forward cross beam 30. It will be observed that cross beam 30 has a very strong cross-section to resist both bending from the weight of the occupant and twisting when the occupant rocks forwardly or backwardly.

Figure 6:
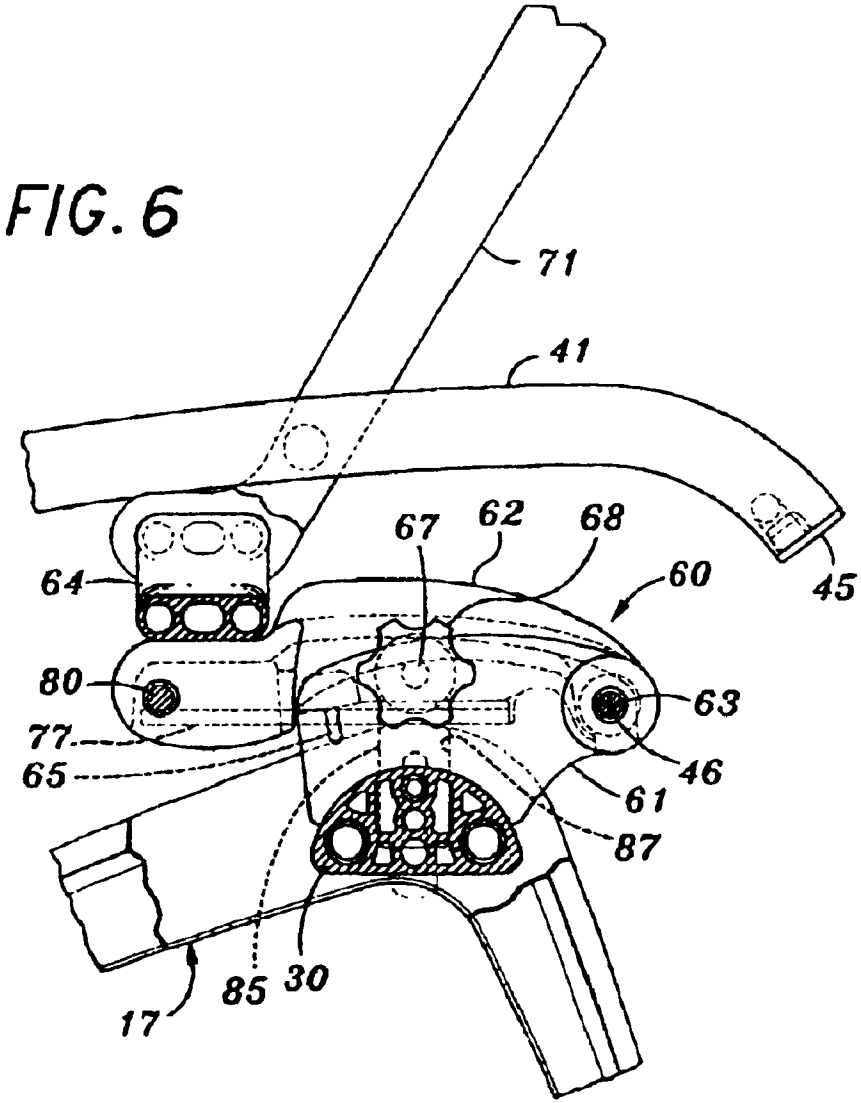
FIG. 6 is a fragmentary cross-section taken at line 6—6 in FIG. 5.

The upper arm 62 (or "jaw") of the control is pivotally mounted to lower arm 61 by a pivot pin 63 (FIG. 6). Pin 63 is on or near the center of curvature 46 of forward lip 45 of the bottom of the support.

The upper arm of the control is firmly attached to a support beam 64. The shallow U shape of beam 64 provides deflection room for a flexible seat bottom when occupied, and also provides minor side wise springiness, which will be slight, but often appreciated. The support beam at its center is fixed to the upper arm so the support beam and the support rotate when the upper arm rotates. As shown, the arms 70 and 71 of the seat are pinned to the support beam.

A limit pin 65 establishes the maximum downward tilt of the control. It may conveniently be attached to the upper jaw. When it strikes the lower jaw, the seat can not tilt farther back.

The control may be disabled by an optional lock which can prevent any relative motion between the arms of the control. Such a lock 66 is shown in FIGS. 12 and 13. It includes a shank 67 and a head 68. It is mounted to the lower arm and passes through it. It may be pressed in to prevent a downward movement of the upper arm by blocking it as shown by placing the shank between the two jaws so they cannot move closer together. When pulled out, the shank is pulled out and rocking motion is again enabled.

The arrangement of the two pivoted arms 61 and 62 of the control allows the support to tilt. The support is held in its uppermost, forwardly tilted position by the control when there is no load on the support. It is maintained in this condition by a pair of cantilever blade-like flexures 73, 74 which are rigidly mounted to the lower jaw, held between plates 75 by bolts 76. The flexures have a free end 77 and a fixed end 78.

A contactor rod 80 extends across and rests on top of the flexures away from the fixed end. This rod is rigidly mounted to the upper arm at its lateral extremes and extends across the upper arm above and in contact with the flexures. A tongue 81 depends downwardly from the upper arm and fits in the space between the flexures to exclude fingers.

Figure 2:
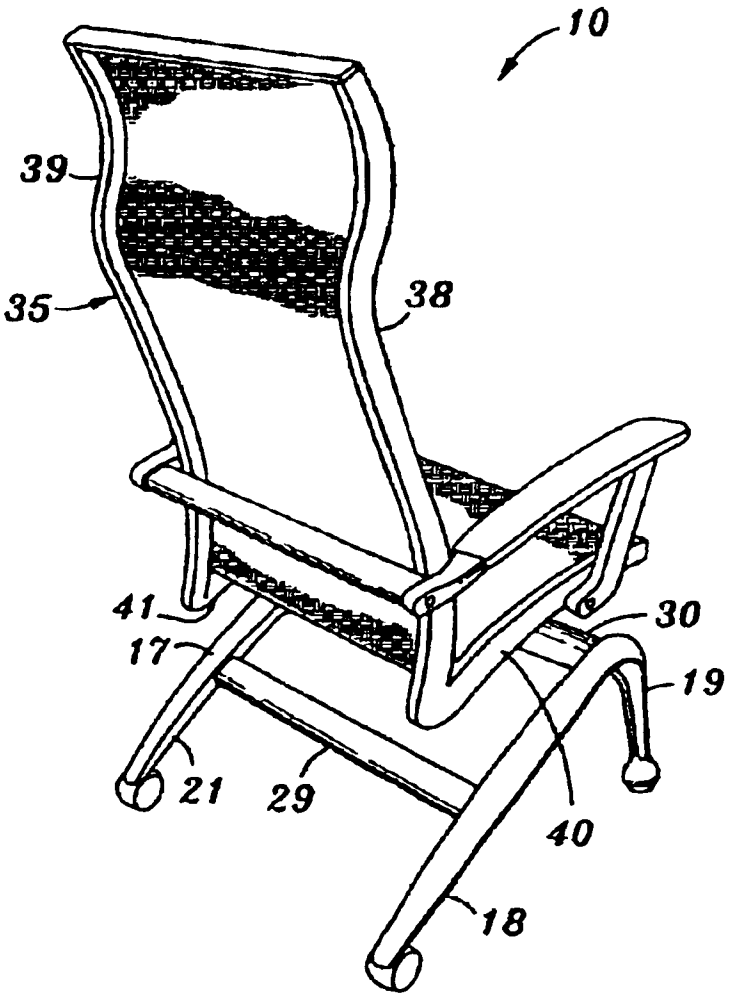
FIG. 2 is a perspective view from the right rear corner of the chair of FIG. 1.
Figure 1:
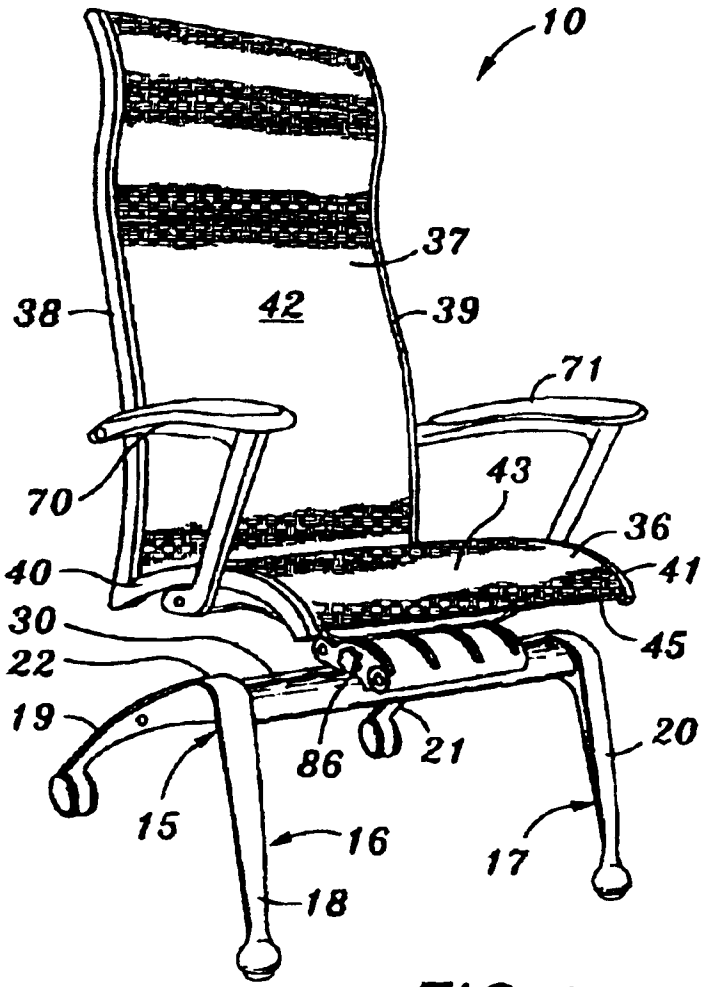
FIG. 1 is a perspective view looking toward the right front corner of a chair utilizing this control.

A load on the support will cause the support to rotate counterclockwise in FIG. 1. Weight on the support causes the control rod to deflect the flexures, and the flexures in turn will exert an upward resilient force tending to resist this weight. The support will assume a position respective to the force on it. An occupant can cause a rocking movement by leaning forwardly or rearwardly on the support. By selecting various thicknesses or lengths of flexures, or properties of the material of construction, the rocking characteristics can be established for a given chair.

The control and thereby also the support are attached to beam 30 by a post 85 fixed to the bottom of the bottom arm.

It fits in a socket 81*a* in cross beam 30. A curved portion 86 of the bottom arm conforms to the outside of the beam. The post passes through a socket 87 in the top of the beam. It will be seen that the control and support are thereby readily attached to the beam wherever there are a pair of aligned holes.

Figure 11:
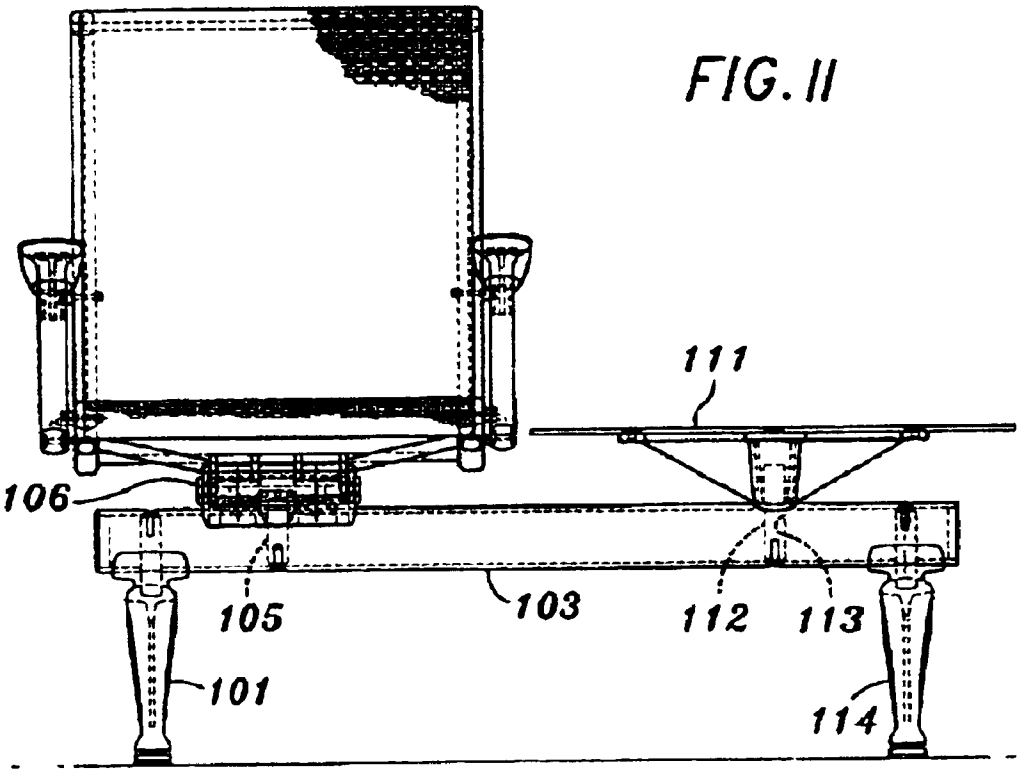
FIG. 11 shows a chair according to this invention combined with other amenities.
Figure 10:
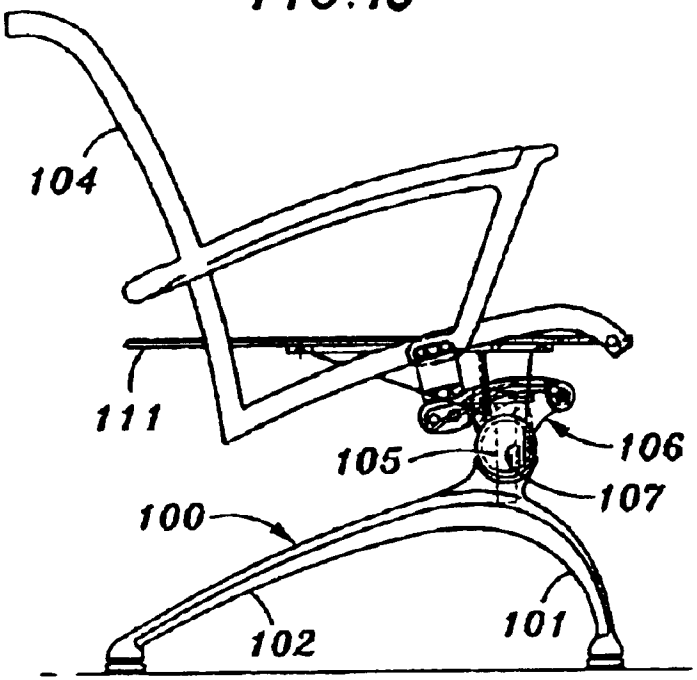
FIG. 10 is a right hand side view of a chair with the same control as in FIG. 1, but with a different seat, and shown in the reclined position.

The illustrated example is for a single patient chair. Its contours are selected to provide long term comfort for the occupant, and can be placed in any suitable location. In fact, FIGS. 10 and 11 show the use of this control along with another amenity. In FIG. 10, a support 100 having struts 101 and 102 has a cross beam 103 which extends far to one side of chair 104. The post 105 of control 106 is placed in a socket 107 as before, and the chair is the same functionally as in FIG. 1. Notice, however the different shape of its back, without a head support.

A table top 111 also has a post 112, which is inserted in socket 113. A second support 114 supports the far end of the cross beam. Now the entire system has additional advantage places not only to sit, but to put things on or even to receive another seat. This is a profoundly useful basic device.

The flexure can be made of any material which is springly bendable. Composite fabric reinforced organic plastic bars are suitable. Instead, metal flexures may be used, as desired. Modification of the control allows for more or less tilting, and even for no tilting at all.

This invention is not limited by the embodiments shown in the drawings and described in the description, which are given by way of example and not of limitation, but only in accordance with the scope of the appended claims.

What is claimed is:

1. Structure to support a seat on which an occupant is to be seated, said structure comprising:

a base comprising a pair of rigid spaced-apart struts, each strut having a front leg and a rear leg, said legs meeting at a junction located forwardly of a mid-point between their lower ends, a rigid cross-beam joined to said struts at said junction, said rear legs proportioned to remain firmly on the ground;

a control comprising a lower arm rigidly attached to said cross-beam, an upper arm on which said support is rigidly mounted, and a pivot rotatably joining said arms near the center of curvature of said arcuate edge forwardly of said mid-point and lower than a knee of an occupant, said arms extending rearwardly from said pivot, whereby an occupant can rock said support while his feet remain on the floor, a rearwardly extending stiffly flexible flexure fixed to said lower arm and extending rearwardly in a cantilever manner toward an unsupported free end between said arms, and a contactor extending across and above said flexure carried by said upper arm so disposed and arranged as to contact the said flexure at a spacing from its attachment to said lower arm so that the flexure will bias the support toward an upper position, weight of an occupant tending to rock the support rearwardly against said bias;

said cross-beam having a convex upper surface, and said lower arm having a matching concave lower surface, said surfaces being in surface contact with one another;

said cross beam having a socket, and said lower arm including a post depending therefrom insertable into said socket to support and maintain said lower arm and upper arm rigidly retained on said cross-beam.

2. Structure according to claim 1, in which a pair of said flexures is provided, said flexures being spaced apart from and parallel to one another.

3. Structure according to claim 2 in which said flexures are unitary bars.

4. A control for inclusion between a base and a support for a seated person, said control being adapted to fit between said support and said base, said base comprising a pair of rigid spaced-apart struts, and a rigid cross-beam joined to said struts;

said control comprising a lower arm adapted to be rigidly attached to said cross-beam, an upper arm on which said support is to be rigidly mounted, and a pivot rotatably joining said arms, a rearwardly extending stiffly flexible blade-like flexure fixed to said lower arm and extending rearwardly in a cantilever manner toward an unsupported free end between said arms, and a contactor extending across and above said flexure so disposed and arranged as to contact the said flexure at a spacing from its attachment to said lower arm so that the flexure will bias the support toward an upper position;

said cross-beam having a convex upper surface, and said lower arm having a matching concave lower surface, said surfaces being in surface contact with one another;

said cross beam having a socket, and said lower arm including a post depending therefrom insertable into said socket to support and maintain said lower arm and upper arm rigidly retained on said cross-beam.

5. A control according to claim 4 in which a pair of said flexures is provided, said flexures being spaced apart from and parallel to one another.

6. A control according to claim 5 in which said flexures are unitary bars.

* * * * *